US005836451A

United States Patent [19]

Dixon

[11] Patent Number: 5,836,451

[45] Date of Patent: Nov. 17, 1998

[54] CARTON HAVING TRAY AND RETURN CARTON

[75] Inventor: Rodney D. Dixon, Burlington, N.C.

[73] Assignee: Mebane Packaging Corporation, Mebane, N.C.

[21] Appl. No.: 927,825

[22] Filed: Sep. 11, 1997

[51] Int. Cl.[6] ..... B65D 69/00

[52] U.S. Cl. ..... 206/569; 206/456; 229/101.2; 229/103; 229/235

[58] Field of Search ..... 206/305, 438, 206/456, 569, 570, 572, 229, 555; 229/101.2, 103, 235

[56] References Cited

U.S. PATENT DOCUMENTS

| | | | |
|---|---|---|---|
| 1,621,451 | 3/1927 | Beach . | |
| 3,395,849 | 8/1968 | Gillam | 229/19 |
| 3,684,084 | 8/1972 | Kanzelberger | 206/45.31 |
| 3,828,923 | 8/1974 | Phillips, Jr. | 206/254 |
| 3,987,955 | 10/1976 | Saarinen | 229/20 |
| 4,524,901 | 6/1985 | Tikka | 229/19 |
| 4,779,723 | 10/1988 | Focke et al. | 206/273 |
| 5,044,500 | 9/1991 | Webber et al. | 206/456 |
| 5,050,735 | 9/1991 | Levy | 206/456 |
| 5,611,433 | 3/1997 | Levy | 206/569 |

*Primary Examiner*—David T. Fidei
*Attorney, Agent, or Firm*—Rhodes, Coats & Bennett, L.L.P.

[57] ABSTRACT

A package for containing both longer and shorter components and being transformable into a secondary package for carrying the shorter components. The package includes a unitary, tubular base carton having first and second ends and a first length extending between the first and second ends. A tear line is formed in the base carton between the first ends and defines a tubular sub-carton and a remainder portion. The sub-carton has a second length extending between the first end of the base carton and the tear line. The second length is less than the first length. A tray is slidably disposed in the sub-carton. The tray has first and second ends and a third length extending between the first and second ends of the tray. The third length is less than the first length of the base carton.

18 Claims, 5 Drawing Sheets

CARTON HAVING TRAY AND RETURN CARTON

FIELD OF THE INVENTION

The present invention is directed to packaging cartons, and, more particularly, to an elongated carton having a removable return portion for shorter components.

BACKGROUND OF THE INVENTION

Certain medical test kits, for example, pap smear test kits, include relatively long items for administering a test, a return package for transporting a test specimen, and written instructions regarding administration of the test. For example, in the case of a pap smear test kit, relatively long swabs are provided for obtaining a test specimen and a glass slide is provided for holding the specimen.

For packaging pap smear tests, it is known to provide packaging having a length sufficient to accommodate the swabs with the slide mounted on one end of the package. The package has a bottom panel and a relatively flimsy canopy which covers the swabs and the slide. The slide is partially inserted into slots in the bottom panel and is thereby held in place. Instructions and the like are printed on the inside and outside of the package. A tear line is formed in the bottom panel and in the canopy so that a portion of the package can be removed from the portion holding the slide. After the specimen is applied to the slide, the canopy portion associated with the slide is folded over the slide for return to a laboratory for evaluation of the specimen. Typically, the physician writes information regarding the specimen, the test, and/or the test subject on the canopy prior to sending the specimen and the return package to the laboratory.

The package described above suffers from several significant drawbacks. The package must be assembled by hand, and is therefore slow and labor intensive to assemble and fill. Because the canopy over the slide is not sturdy, there is a tendency for the canopy to contact the slide and the specimen thereon when the physician writes on the outside of the canopy, thereby contaminating the specimen. Because the canopy must be opened and reclosed to access and repackage the slide, a significant degree of effort and dexterity is required of the physician.

There exists a need for a package for test kits of the type having relatively long components and shorter components which must be repackaged and returned. In particular, there exists a need for such a package which is cost effective and convenient to assemble and fill, and, moreover, which is convenient to use. Further, there is a need for such a package wherein the return portion is adapted to protect a test specimen. In particular, the return package should resist contact between the package and the specimen when, for example, pressure is applied to the package by a user writing on the outside of the package.

SUMMARY OF THE INVENTION

The present invention is directed to a package for containing both longer and shorter components and being transformable into a secondary package for carrying the shorter components. The package includes a unitary, tubular base carton having first and second ends and a first length extending between the first and second ends. A tear line is formed in the base carton between the first and second ends and defines a tubular sub-carton and a remainder portion. The sub-carton has a second length extending between the first end of the base carton and the tear line, the second length being less than the first length. A tray is slidably disposed in the sub-carton. The tray has first and second ends and a third length extending between the first and second ends of the tray. The third length is less than the first length of the base carton.

The remainder portion may include first and second overlapping edge portions extending along at least a portion of the first length. The first and second edge portions are detachably secured to one another so that the first edge portion may be pulled away from the second edge portion to open the remainder portion to expose an inner surface thereof. Preferably, indicia are disposed on the inner surface of the remainder portion and may be inspected upon opening of the remainder portion.

Preferably, the tray includes at least one stop tab operative to limit insertion of the tray into the sub-carton.

In a preferred embodiment, the tray includes an end panel formed on at least one of the first and second ends thereof. The end panel is selectively positionable with respect to the sub-carton to form an end closure for a return package including the sub-carton and the tray. Moreover, the tray may include an end panel on each of the first and second ends thereof, each of the end panels selectively positionable with respect to the sub-carton to form opposed end closures for the return package. Preferably, the tray includes at least one stop tab extending from at least one end panel and operative to limit insertion of the tray into the sub-carton.

The tray may include a carrier panel and at least one side wall extending along the third length of the tray and substantially perpendicular to the carrier panel. Preferably, the tray includes at least two of the side walls. Each of the side walls extend along opposed, lengthwise extending edges of the carrier panel.

In a preferred embodiment, the sub-carton includes at least one integrally formed side flap defined by the tear line. Preferably, indicia is disposed on an exposed panel of the sub-carton.

The present invention is further directed to a method for assembling a kit including a longer component, a shorter component, and a package containing each of the larger and shorter components and being transformable into a secondary package for carrying the shorter component. The method includes the step of providing a unitary, tubular base carton having first and second ends and a first length extending between the first and second ends, a tear line formed in the base carton between the first and second ends and defining a tubular sub-carton and a remainder portion, the sub-carton having a second length extending between the first end of the base carton and the tear line, the second length being less than the first length. The shorter component is mounted on a tray having first and second ends and a third length extending between the first and second ends of the tray, the third length being less than the first length of the base carton. The tray with the shorter component mounted thereon is slid into the sub-carton.

The preceding and objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

Figure 1:
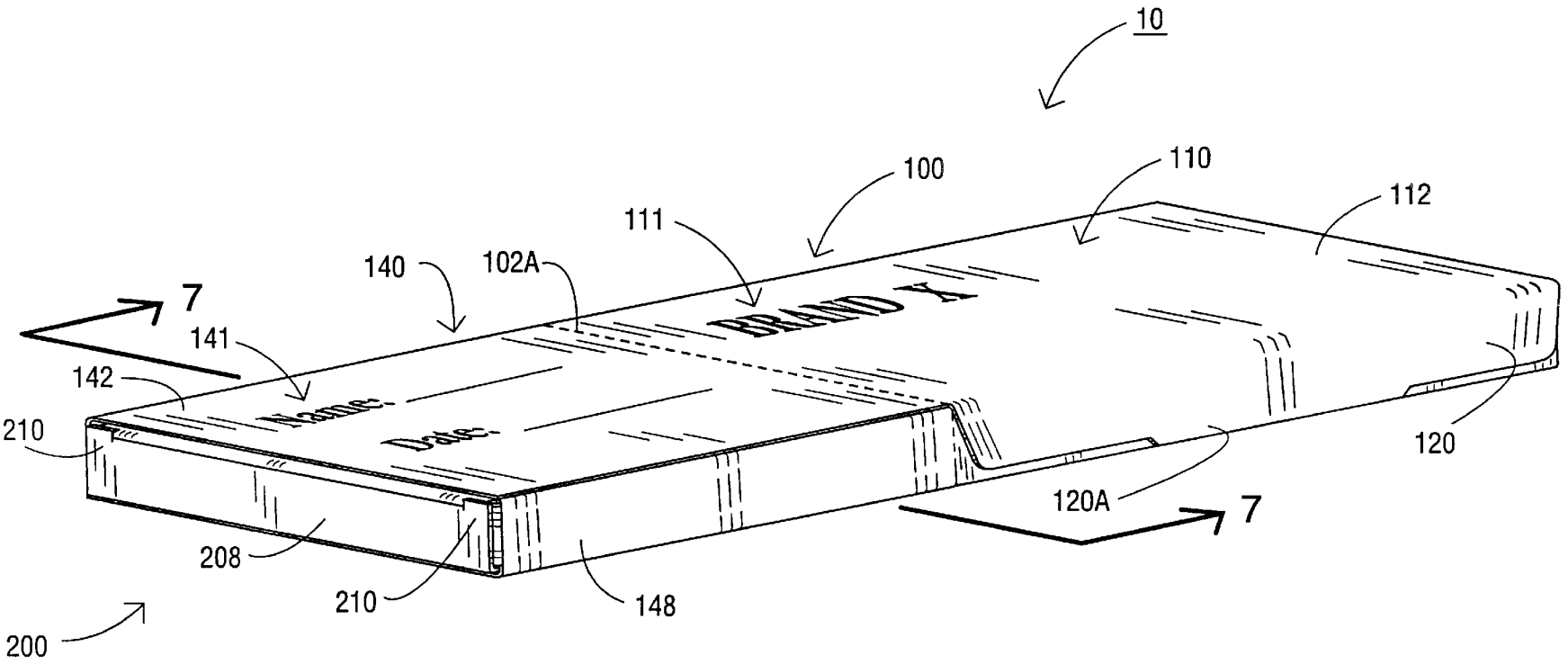
FIG. 1 is a perspective view of a package according to the present invention in a closed position.
Figure 4:
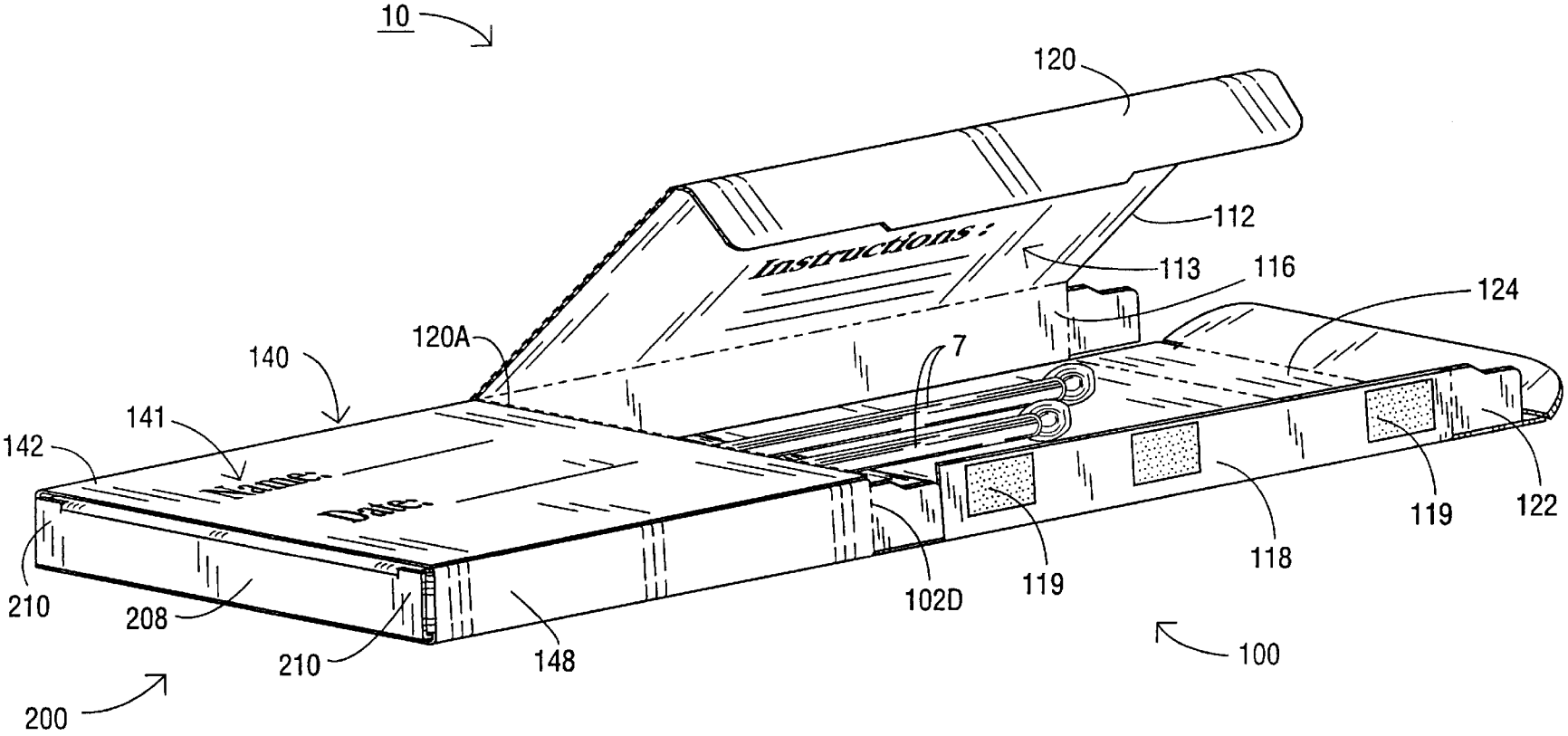
FIG. 4 is a perspective view of the package with the top flap pulled open.
Figure 5:
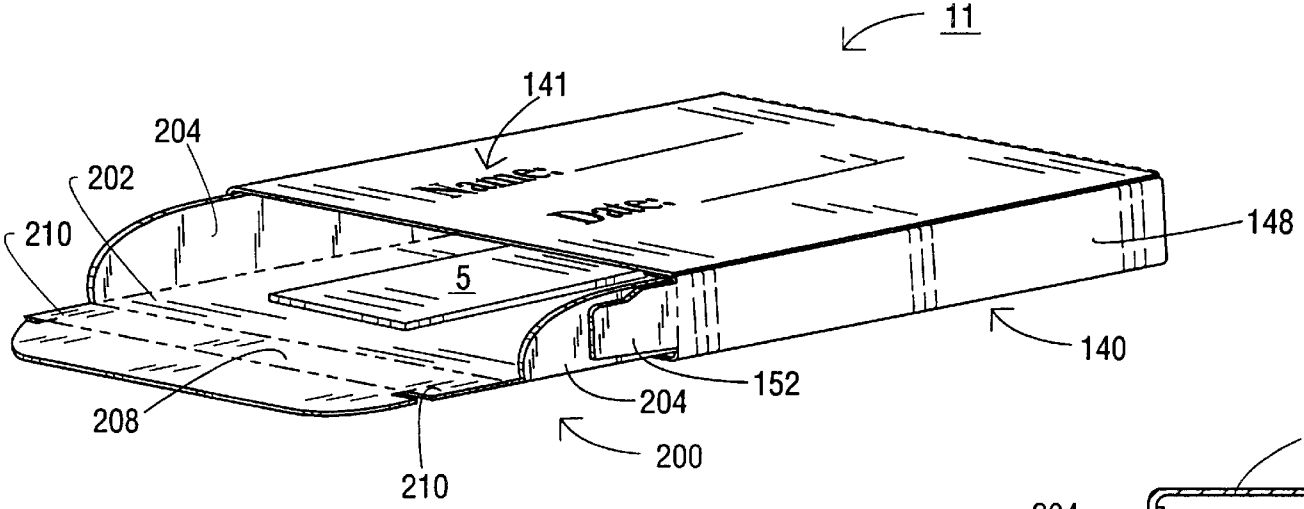
FIG. 5 is a perspective view of a return carton formed from the package with the tray partially withdrawn therefrom.
Figure 6:
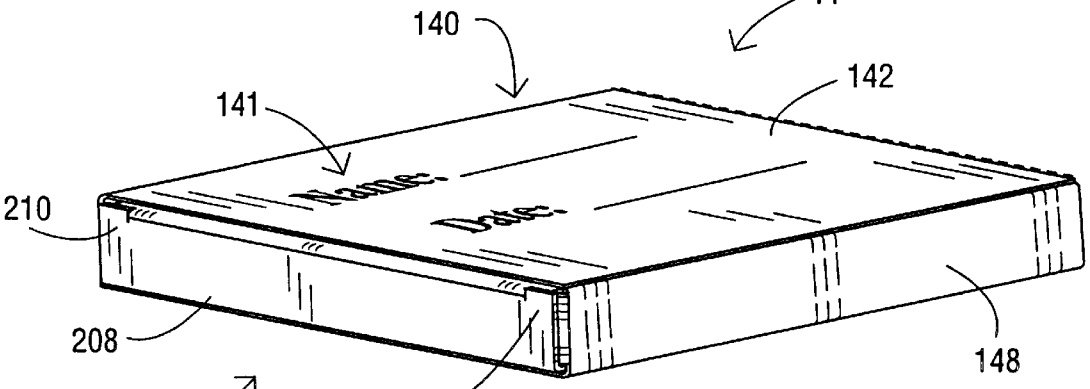
FIG. 6 is a perspective view of the return carton.

With reference to FIGS. 1 and 4, a package 10 according to the present invention is shown therein. Package 10 is adapted to hold a specimen slide 5 (see FIG. 5) and one or more swabs 7 (see FIG. 4). However, it will be readily appreciated by those of ordinary skill in the art that the package as described herein may be used to hold various other articles. Package 10 includes, generally, unitary main carton 100 and unitary tray 200 slidably disposed in main carton 100. As will be more fully appreciated from the description below, package 10 may be conveniently and cost effectively assembled and filled with slide 5 and swabs 7. Further, package 10 is reconfigurable to form a return package 11 as shown in FIGS. 5 and 6.

Throughout the Figures, fold lines are indicated by lines of long and short dashes and tear lines are indicated by lines of short dashes.

Figure 2:
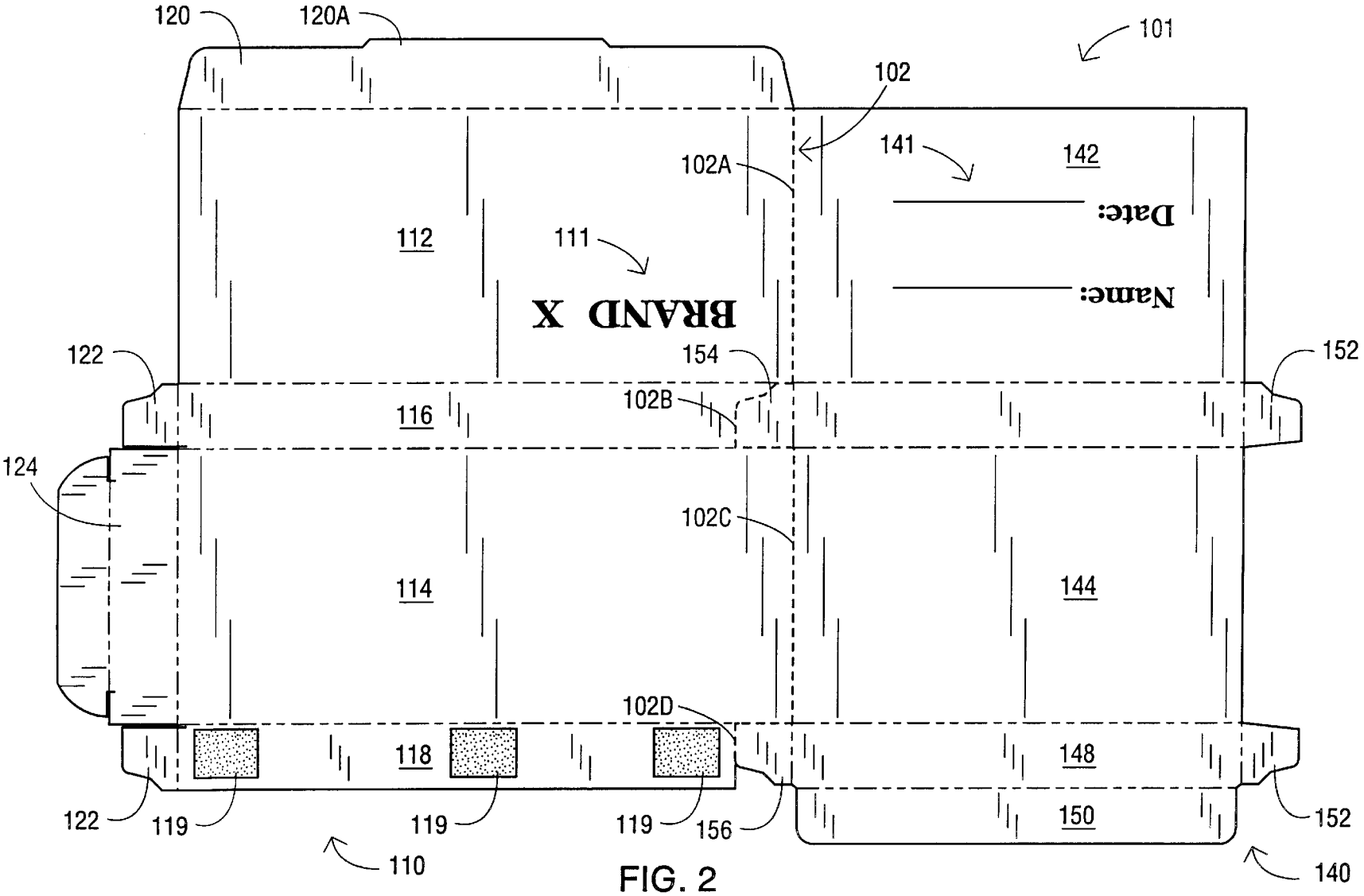
FIG. 2 is a top plan view of a blank for forming a main carton forming a part of the package.

Main carton 100 is formed from carton blank 101 as shown in FIG. 2. Main carton blank 101 is preferably formed of 0.016 SBS. Suitable methods for forming blank 101 will be readily appreciated by those of ordinary skill in the art upon a reading of the description herein. Generally, main carton 100 (and carton blank 101) includes a return portion 140 including the portion of blank 101 to the right of tear line 102 as shown in FIG. 2 and a remainder portion 110 including those portions of blank 101 to the left of tear line 102 as shown in FIG. 2.

Main carton 100 has top panels 112, 142 joined along tear line portion 102A. Suitable indicia 111 such as brand names, warnings, and instructions are printed on the upper surface of top panel 112. Suitable indicia such as a serial number and prompts for identification data are printed on the upper surface of top panel 142. Front flap 120 extends along top panel 112 and has pull tab 120A.

Bottom panel 114 is connected to top panel 112 by vertical back panel 116. Bottom panel 144 is joined to top panel 142 by vertical back panel 146. Side flaps 122 and 152 extend from panels 116 and 146, respectively. Side flap 154 extends from panel 146 and is defined by tear line portion 102B. Bottom panels 114 and 144 are joined along tear line portion 102C. End flap 124 extends from bottom panel 114.

Front panel 118 extends along bottom panel 114 and has pre-cut glue zones 119. Pre-cut zones 119 have die cuts thereabout which extend only partly into the carton material. Side flap 122 extends from front panel 119. Front panel 148 extends along bottom panel 144 and has side flap 152 extending therefrom. Side flap 156 extends from panel 148 and is defined by tear line portion 102D. Underflap 150 extends along front panel 148.

Figure 3:
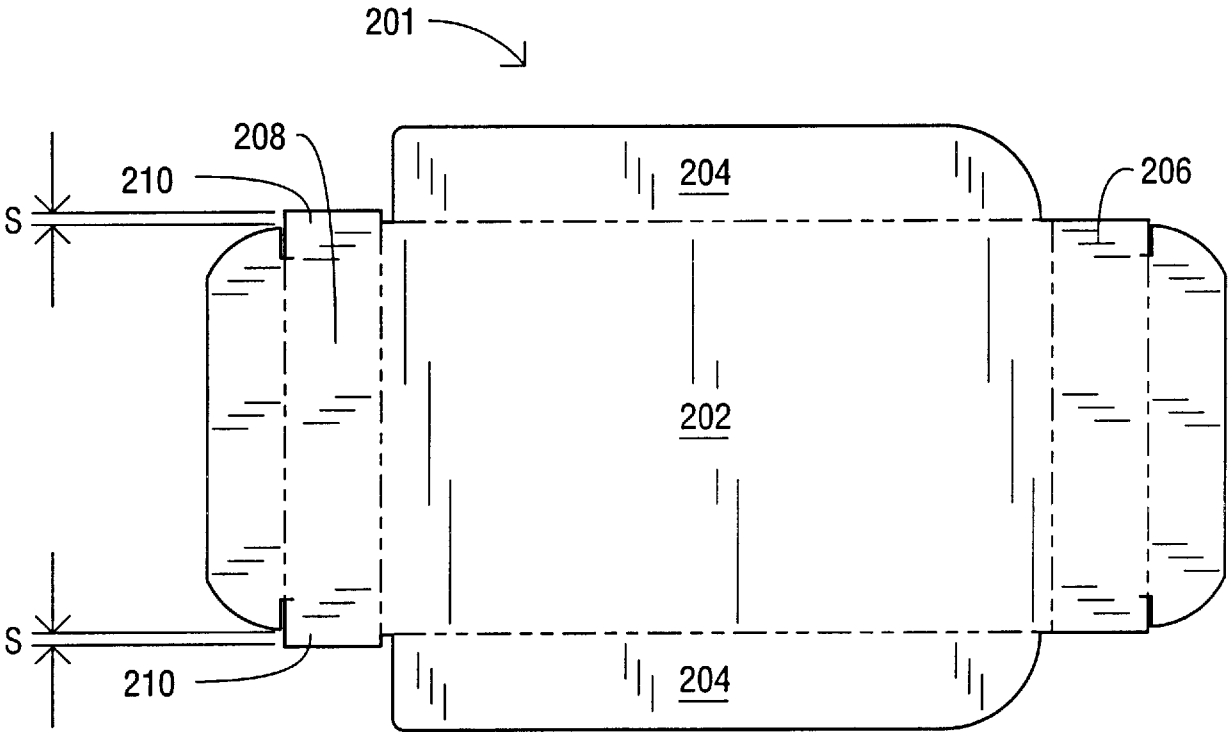
FIG. 3 is a top plan view of a blank for forming a tray forming a part of the package.

With reference to FIG. 3, a blank 201 for forming tray 200 is shown therein. Blank 201 is preferably formed from the same materials as blank 101. Suitable methods for forming blank 201 will be readily appreciated by those of ordinary skill in the art upon reading the description herein.

Blank 201 has bottom panel 202, side walls 204 extending along either side of panel 202, and end flaps 206, 208 extending along either end of panel 202. End flap 208 has integral stop tabs 210 extending sidewardly a distance S beyond the adjacent edges of bottom panel 202. Distance S is preferably at least 1/32 inch, and more preferably from about 1/32 inch to 3/64 inch.

Figure 7:
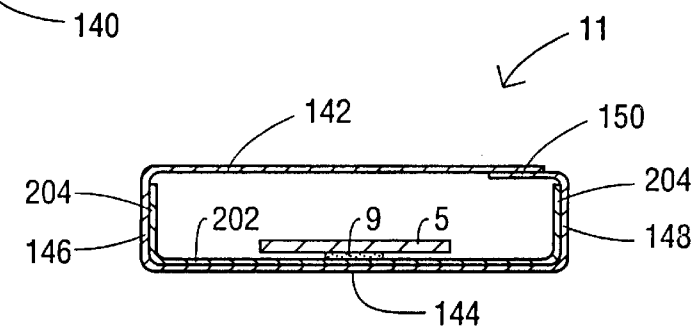
FIG. 7 is a cross-sectional, end view of the return carton.

Main carton 100 is assembled by folding blank 101 into a tubular construction as shown, gluing flap 120 over front panel 118 at zones 119, and gluing top panel 142 over flap 150. To assemble tray 200, side walls 204 of blank 201 are folded to right angle positions with respect to bottom panel 202. Tray 200 thus formed is inserted into main carton 100 from left to right as shown in FIG. 1 to assemble package 10. Typically, slide 5 will be glued (glue 9, as shown in FIG. 7) to bottom panel 202 prior to insertion of the tray into the main carton.

The interior width of main carton 100 at return portion 140 is preferably only from about 1/16 inch to 5/64 inch greater than the width of bottom panel 202. As noted above, stop tabs 210 preferably extend from about 1/32 inch to 3/64 inch beyond the side edges of bottom panel 202. As a result, stop tabs 210 prevent tray 200 from being inserted into main carton 100 beyond the adjacent end of bottom panel 202. The length of bottom panel 202 is substantially the same as the corresponding length of bottom panel 144. Accordingly, when tray 200 is fully inserted as shown in FIG. 1, end flap 206 extends beyond tear line 102. Swabs 7 are inserted into package 10, side flaps 122, 152 are folded inwardly, and flaps 208 and 124 are folded upwardly to close the openings of package 10.

When the user, for example a doctor, desires to access the swabs 7 or to inspect indicia 113, for example instructions, on the underside of top panel 112, he or she lifts tab 120A, separating flap 120 at zones 119 from panel 118. As the doctor continues pulling upwardly on flap 120, top panel 112 is separated from top panel 142 along tear line portion 102A. Alternatively, if the doctor does not wish to lift top panel 112, he or she may remove swabs 7 by opening end flap 124. Slide 5 may be accessed by opening flap 208 and withdrawing the tray.

To prepare the return package, the doctor or other user pulls flap 120 upwardly and continues pulling along tear line 102 until return portion 140 is entirely separated from remainder portion 100. Notably, side flaps 154 and 156 will remain with return portion 140. Return portion 140 is completed by folding side flaps 152, 154, 156 inwardly and folding end flap 206 over the tube opening adjacent the tear line. A self contained return carton 11 is thereby formed, end flaps 208 and 206 of tray 200 forming the end walls of the return carton. The slide 5 may be accessed and repackaged as desired by pulling out flaps 206 and 208 and withdrawing and reinserting tray 200.

Typically, it will be necessary or desirable for the doctor to write certain identification information relating to the slide specimen on the return carton 11. The doctor may write such information on top panel 142 and is prompted to do so by indicia 141. As best seen in FIG. 7, return package 11 is adapted to withstand the force of the doctor writing on top panel 142 so that top panel 142 is not deflected downwardly and into contact with the specimen on slide 5. In particular, return portion 140 of carton 11 has vertical walls 146, 148 extending at right angles to top panel 142 and bottom panel 144. The inherent crush resistance of this configuration is substantially increased by the further provision of vertical walls 204 which, with walls 146, 148, provided double walled support.

The package of the present invention may, of course, be used to package items other than pap smear test kits, for example, soil test kits.

While a preferred embodiment of the present invention has been described, it will be appreciated by those of skill in the art that certain modifications may be made without departing from the scope of the present invention. All such modifications are intended to come within the scope of the claims which follow.

What is claimed is:

1. A package for containing both longer and shorter components and being transformable into a secondary package for carrying the shorter components, said package comprising:

a) a unitary, tubular base carton having first and second ends and a first length extending between said first and second ends;

b) a tear line formed in said base carton between said first and second ends and defining a tubular sub-carton and a remainder portion, said sub-carton having a second length extending between said first end of said base carton and said tear line, said second length being less than said first length; and c) a tray disposed in said sub-carton, said tray having first and second ends and a third length extending between said first and second ends of said tray, said third length being less than said first length of said base carton.

2. The package of claim 1 wherein said remainder portion includes first and second overlapping edge portions extending along at least a portion of said first length, said first and second edge portions detachably secured to one another so that said first edge portion may be pulled away from said second edge portion to open said remainder portion to expose an inner surface thereof.

3. The package of claim 2 including indicia disposed on said inner surface of said remainder portion which may be inspected upon opening of said remainder portion.

4. The package of claim 1 wherein said tray includes at least one stop tab operative to limit insertion of said tray into said sub-carton.

5. The package of claim 1 wherein said tray includes an end panel formed on at least one of said first and second ends thereof and selectively positionable with respect to said sub-carton to form an end closure for a return package including said sub-carton and said tray.

6. The package of claim 5 wherein said tray includes an end panel on each of said first and second ends thereof, each of said end panels selectively positionable with respect to said sub-carton to form opposed end closures for said return package.

7. The package of claim 5 wherein said tray includes at least one stop tab extending from said at least one end panel and operative to limit insertion of said tray into said sub-carton.

8. The package of claim 1 wherein said tray includes a carrier panel and at least one side wall extending along said third length of said tray and substantially perpendicular to said carrier panel.

9. The package of claim 8 wherein said tray includes at least two of said side walls each extending along opposed, lengthwise extending edges of said carrier panel.

10. The package of claim 1 wherein said sub-carton includes at least one integrally formed side flap defined by said tear line.

11. The package of claim 1 including indicia disposed on an exposed panel of said sub-carton.

12. A package comprising:

a) a unitary, tubular base carton having first and second ends and a first length extending between said first and second ends;

b) a tear line formed in said base carton between said first and second ends and defining a tubular sub-carton and a remainder portion, said sub-carton having a second length extending between said first end of said base carton and said tear line, said second length being less than said first length;

c) a tray slidably disposed in said sub-carton, said tray comprising:

i) first and second ends and a third length extending between said first and second ends of said tray, said third length being less than said first length of said base carton;

ii) an end panel formed on at least one of said first and second ends thereof and selectively positionable with respect to said sub-carton to form an end closure for a return package including said sub-carton and said tray;

iii) at least one stop tab operative to limit insertion of said tray into said sub-carton;

iv) a carrier panel; and v) a side wall extending along said third length of said tray and substantially perpendicular to said carrier panel;

d) wherein said remainder portion includes first and second overlapping edge portions extending along at least a portion of said first length, said first and second edge portions detachably secured to one another so that said first edge portion may be pulled away from said second edge portion to open said remainder portion to expose an inner surface thereof; and e) indicia disposed on said inner surface of said remainder portion which may be inspected upon opening of said remainder portion.

13. The package of claim 12 wherein said tray includes an end panel on each of said first and second ends thereof, each of said end panels selectively positionable with respect to said sub-carton to form opposed end closures for said return package.

14. The package of claim 12 wherein said tray includes at least two of said side walls each extending along opposed, lengthwise extending edges of said carrier panel.

15. The package of claim 12 wherein said sub-carton includes at least one integrally formed side flap defined by said tear line.

16. The package of claim 12 wherein said at least one stop tab extends outwardly from said end panel.

17. The package of claim 12 including indicia disposed on an exposed panel of said subcarton.

18. A method for assembling a kit including a longer component, a shorter component, and a package containing each of the larger and shorter components and being transformable into a secondary package for carrying the shorter component, said method comprising the steps of:

a) providing a unitary, tubular base carton having first and second ends and a first length extending between the first and second ends, a tear line formed in the base carton between the first and second ends and defining a tubular sub-carton and a remainder portion, the sub-carton having a second length extending between the first end of the base carton and the tear line, the second length being less than the first length;

b) mounting the shorter component on a tray having first and second ends and a third length extending between the first and second ends of the tray, the third length being less than the first length of the base carton; and c) sliding the tray with the shorter component mounted thereon into the sub-carton.

* * * * *

UNITED STATES PATENT AND TRADEMARK OFFICE

CERTIFICATE OF CORRECTION

PATENT NO. : 5,836,451

DATED : November 17, 1998

INVENTOR(S) : Rodney Dixon

It is certified that error appears in the above-identified patent and that said Letters Patent is hereby corrected as shown below:

In Claim 1(c), line 23, insert -- slidably -- after tray (first occurrence).

Signed and Sealed this

Sixteenth Day of March, 1999

*Attest:*

*Attesting Officer*

Q. TODD DICKINSON

*Acting Commissioner of Patents and Trademarks*